US005441664A

United States Patent [19]

Blanvalet et al.

[11] Patent Number: 5,441,664

[45] Date of Patent: Aug. 15, 1995

[54] GELLED HARD SURFACE CLEANING COMPOSITION

[75] Inventors: Claude Blanvalet, Angleur, Belgium; Mary C. Brauchli, Maplewood, N.J.; Jolanta Dautas, Kirtland, Ohio; Constance A. Marchese, Edison, N.J.

[73] Assignee: Colgate Palmolive Co., Piscataway, N.J.

[21] Appl. No.: 151,621

[22] Filed: Nov. 15, 1993

[51] Int. Cl.[6] ..... C11D 9/24; C11D 9/30; C11D 9/32; C11D 9/44

[52] U.S. Cl. ..... 252/117; 252/118; 252/121; 252/134; 252/156; 252/174.19; 252/545; 252/547; 252/DIG. 14

[58] Field of Search ..... 252/546, 544, 545, DIG. 14, 252/DIG. 15, 117, 108, 156, 174.11, 174.19

[56] References Cited

U.S. PATENT DOCUMENTS

| | | | |
|---|---|---|---|
| 3,580,853 | 5/1971 | Parran | 252/152 |
| 4,690,779 | 9/1987 | Baker et al. | 252/546 |
| 5,164,120 | 11/1992 | Borland et al. | 252/546 |
| 5,167,872 | 12/1992 | Pancheri et al. | 252/544 |
| 5,223,179 | 6/1993 | Connor et al. | 252/548 |

*Primary Examiner*—Glennon H. Hollrah
*Assistant Examiner*—Deborah Lambkin
*Attorney, Agent, or Firm*—Richard E. Nanfeldt; Robert C. Sullivan; Murray Grill

[57] ABSTRACT

A cleaning composition which comprises approximately by weight 2 to 35% of at least one unsaturated fatty acid having about 8 to 24 carbon atoms; 0.01 to 1.5% of a trialkanolamine; 0.01 to 1.5% of an alkanol having about 1 to about 5 carbon atoms; 1 to 5.0% of an alkali metal hydroxide; 0.02 to 2.0% of an amine oxide; 0.02 to 2.0% of a sultaine; 0.05 to 3.0% of an acidic gelling agent; and the balance being water.

24 Claims, No Drawings

GELLED HARD SURFACE CLEANING COMPOSITION

FIELD OF THE INVENTION

The present invention relates to gelled compositions for cleaning hard surfaces in the household or industrial environment, wherein the main components of these hard surface cleaning compositions are a metal neutralized unsaturated fatty acid and an acidic gelling agent.

BACKGROUND OF THE INVENTION

A vast number of cleaning materials have long been known which have potential applications to the problem of the cleaning of objects and environments which have a hard surface. Such objects and environments include wooden floors; floors covered with tile, linoleum or an equivalent no wax covering; kitchen cabinets and other storage items, fixed or free standing; appliances, such as refrigerators, dishwashers, ranges, microwave ovens and the like; and furniture, such as tables, sideboards and the like. Known cleaning materials for use in cleaning such objects and environments range from natural soaps and detergents to more complex synthetic cleaning solvent compositions. Known cleaning compositions may range from very mild furniture cleaners, to mild yet effective wax strippers, to harsh, powerful degreasers. In most instances, such compositions broadly comprise a surfactant system for soil penetration, loosening and emulsification, along with appropriate coupling agents and performance modifiers. In the case of degreasers, for example, solvents of various types may be used, including glycol ethers, petroleum solvents, glycols and/or alcohols. A mild product, in contrast, must usually avoid the use of strong solvents and lower molecular weight glycol ethers, while a wax stripper will include significant quantities of light amine and stronger glycol ethers.

Cleaning materials effective for use in household applications for cleaning hard surfaces present specific problems relating both to convenience and simplicity of the use of the material and to its required performance and safety characteristics. The required performance characteristics also vary depending upon the inherent characteristics of the surface to be cleaned. Securing a cleaning material which provides the combination of convenience and simplicity of use, with the required performance and safety characteristics, has long been a desired objective which has often met with little success.

Broadly known household cleaning compositions generally consist of a non-ionic surfactant system (ethoxylated alcohols, amides and the like), alkaline builders (sodium carbonate, phosphates, silicates and the like), glycol ethers (ethylene, propylene, diethylene, and dipropylene glycol type ethers) and possibly a chelant (EDTA, citrate and the like).

Generally, for broad use and effectiveness, a cleaning composition must be chemically neutral to the surface which is being cleaned, and otherwise cause no adverse reaction of effect on said surface. This is a particular problem where a substantially solvent-based system is used in connection with a plastic, wood or composite surface, while the cleaning of metal of porcelain-coated metal surfaces may also be adversely affected if cleaned with a substantially acid or alkaline system. These adverse effects can include dulling, scarring or streaking of the surface, or the dissolving of all or a portion of the surface, causing substantial and irreparable damage.

Even if chemically neutral, or effectively neutral to the surface being cleaned, a cleaning composition may dull the shine or gloss that the surface inherently possesses. Materials such as acrylic surfaces, laminated surfaces (bearing Formica brand or an equivalent laminate) and certain metal surfaces, either inherently or by prior treatment, display a desired gloss or shine when clean. It is the function of an effective cleaning composition for such a surface to remove grease, dirt and other deleterious substances, thereby cleaning the surface and restoring the inherent shine or gloss that the surface possesses when clean.

Conversely, a number of surfaces, either inherently or by design, present a dull or matte surface when clean. It is the function of an effective cleaning composition for such a surface to remove grease, dirt and other deleterious substances, thereby cleaning the surface, without imparting a gloss or shine to the surface when clean.

No known cleaning composition useful for the cleaning of hard surfaces, as described, presents the property of cleaning an inherently shiny or glossy surface, while restoring that shine or gloss, yet when applied to clean an inherently dull or matte surface, cleans that surface without imparting undesired shine or gloss.

Cleaning compositions useful for household applications in cleaning hard surfaces must also display a number of other often conflicting properties and characteristics. In most instances, they should preferably be a spray on/wipe off type cleaners. Because of the danger, undesirable odor and harshness, substantially non-aqueous solvent based compositions are undesirable, particularly all non-aqueous, strong organic solvent-based systems. Cleaning compositions must also be stable in storage and in use-no clouding, separation or precipitation of component materials from solution should occur. Of course, the cleaning composition must provide adequate cleaning function to clean and remove a variety of grease, dirt, carbonaceous soils, marking materials or ink, and other deleterious materials, particularly greasy and oily materials, encountered in a household environment from the surfaces described above. That cleaning must occur, however, without the composition streaking or otherwise leaving a film upon the cleaned surface. Of course, the composition must not possess an unpleasant or unacceptable odor-such as a heavy cleaner or detergent odor-either in use or upon the cleaned surface.

The known cleaning compositions do not present the desired combination of characteristics and performance properties described. There has long been an unfilled need for a cleaning composition, having particular efficacy in household applications, having the following optimum combination of characteristics:

1. The ability to clean hard surfaces of a variety of materials encountered in a household environment, including but not limited to grease, dirt, carbonaceous soils, marking materials or ink, and the like, without leaving a film or streaking the cleaned surface;
2. The ability to provide said cleaning action without deleterious effect on said hard surface, even if that surface comprises a finished wood having a varnished, sealed or painted surface, or a plastic material;

3. The ability to clean a hard surface, whereby a gloss or shine is imparted or restored only if said surface initially presented a gloss or shine when clean, but not to impart a gloss or shine if said surface initially presented a dull or matte surface when clean; and
4. Lack of any objectionable odor.
5. A cleaning composition which readily adheres to a vertical surface and does not readily run down or sag off of the vertical surface to be cleaned.

SUMMARY OF INVENTION

The invention provides the combination of characteristics and performance properties necessary for an effective cleaning compositions for hard surface applications. The instant invention comprises a cleaning composition, which may be used as is or diluted with water, comprising:

a) 2 to 35 wt % of at least one alkali metal salt of a fatty acid having about 8 to about 24 carbon atoms such as that in a tall oil fatty acid;
b) 1 to 5 wt % of an alkali metal hydroxide;
c) 0.02 to 2.0 wt % of a sultaine;
d) 0.02 to 2.0 wt % of an amine oxide;
e) 0.01 to 1.5 wt % of an alkanol having about 1 to about 5 carbon atoms;
f) 0.01 to 1.5 wt % of triethanolamine;
g) 0.01 to 1.5 wt % of a perfume;
h) 0.05 to 3.0 wt %, more preferably 0.1 to 2.5 wt %, of an acidic gelling agent having the formula

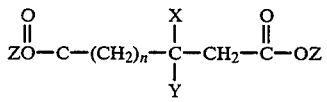

wherein n=0, 1 or 2, X is selected from the group consisting of hydrogen, an alkoxy group having 1 to 4 carbon atoms, and a hydroxy group, Z is selected from the group consisting of hydrogen and an alkali metal cation, and mixtures thereof, and Y is selected from the group consisting of hydrogen, $CO_2H$ and $CO_2Z$; and i) the balance being water, wherein the composition has a pH of about 9 to about 13, at a concentration of about 10 grams of the composition in 100 ml. of water, a specific gravity at 20° C. of about 0.95 to 1.10 g/cm$^3$ and a Brookfield viscosity at room temperature using a #2 spindle at 20 rpms of about 2000 to about 100,000 cps, more preferably about 2000 to about 10,000 cps.

It is therefore an object of this invention to provide a novel, safe gelled or semi-solid-like cleaning composition able to clean vertical hard surfaces of a variety of undesired materials encountered in a household environment, without leaving a film or streaking the surface once cleaned and without deleterious effect on said vertical hard surface, even if that surface comprises a finished wood having a varnished, sealed or painted surface, or a plastic material.

It is another object of this invention to provide a novel cleaning composition which imparts or restores a gloss or shine to a hard surface being cleaned, if said surface initially presented a gloss or shine when clean, but does not impart a gloss or shine to the surface cleaned if said surface initially presented a dull or matte surface when clean.

Other objects and advantages of this invention with become apparent upon reading the following detailed description and appended claims.

DESCRIPTION OF THE PREFERRED EMBODIMENT

The present invention relates to a hard surface cleaning composition having a Brookfield viscosity at room temperature, #2 spindle, 20 rpms greater than 2000 cps, more preferably 2000 to 100,000 cps and most preferably 2000 to 10,000 cps, which is especially adaptable for the cleaning of wood surfaces, wherein the composition comprises a long chain unsaturated fatty acid, an alkali metal hydroxide, a cocoamido-alkylhydroxy sultaine, an amine oxide, an alkanol having about 1 to about 5 carbon atoms, a trialkanolamine, a perfume, an acidic gelling agent and water.

The preferred long chain unsaturated fatty acids of the instant invention have about 8 to about 24 carbon atoms, more preferably about 10 to about 20 carbon atoms. A preferred unsaturated fatty acid mixture is a refined tall oil fatty acid. A typical tall oil fatty acid contains mono unsaturated $C_{16-18}$ fatty acid; a $C_{18}$ diene unsaturated fatty acid; a $C_{16-18}$ triene unsaturated fatty acid; and a $C_{16-18}$ saturated fatty acid. Other unsaturated fatty acids that are usable in the instant compositions are unsaturated vegetable oil fatty acids, including soy, peanut, corn, cottonseed, linseed and refined oleic fatty acids, and fatty acids consisting predominantly of $C_{18}$ (average) unsaturated fatty acids and mixtures thereof. The unsaturated fatty acid reacts in situ with the alkali metal hydroxide to form the alkali metal salt of the unsaturated fatty acid. The concentration of the unsaturated fatty acid is about 2 to about 35 wt %, more preferably about 4 to about 25 wt % and most preferably about 6 to about 18 wt %. The alkali metal hydroxide is preferably potassium hydroxide and is present in the composition at a concentration of about 1 to about 5 wt %, more preferably about 1.2 to about 4.5 wt % and most preferably about 1.5 to about 4 wt %. The potassium hydroxide reacts in situ with the fatty acid in the composition to form the potassium salt of the fatty acid.

The preferred trialkanolamine used in the instant composition is triethanolamine which is used at a concentration in the composition of about 0.01 to about 1.5 wt %, more preferably about 0.08 to about 1.0 wt %. The trialkanolamine reacts in situ with the unsaturated fatty acid to form an alkanol amine salt of the unsaturated fatty acid thereby functioning as a means for adjusting the viscosity of the composition. The viscosity of the composition is further controlled by the addition of about 0.01 to about 1.5 wt % of an alkanol having about 1 to about 5 carbon atoms, more preferably about 0.1 to about 1.0 wt %. Preferred alkanols are ethanol, isopropanol or propanol.

The composition contains about 0.02 to about 2.0 wt % of an amine oxide, more preferably about 0.05 to about 1.5 wt % and most preferably about 0.1 to about 1.0 wt %. The preferred amine oxide is cocoamidopropylamine oxide. The amine oxide is depicted by the formula:

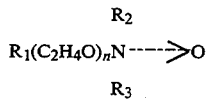

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms; $R_2$ and $R_3$ are each methyl, ethyl, propyl, isopropyl, 2-hydroxyethyl, 2-hydroxypropyl, or 3-hydroxypropyl; and n is from 0 to about 10. Particularly preferred are amine oxides of the formula:

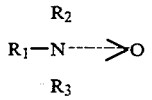

wherein $R_1$ is a $C_{12-18}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference. An especially preferred amine oxide is depicted by the formula:

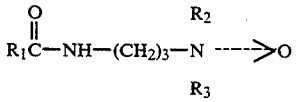

wherein $R_1$ is a saturated or unsaturated alkyl group having about 6 to about 24 carbon atoms, $R_2$ is a methyl group, and $R_3$ is a methyl or ethyl group. The preferred amine oxide is cocoamidopropyl-dimethylamine oxide.

The composition also contains about 0.02 to about 2.0 wt %, more preferably about 0.05 to about 1.5 wt % and most preferably about 0.1 to about 1.0 wt % of a sultaine which is preferably a cocoamido-propylhydroxy sultaine. The sultaine can be depicted by the formula:

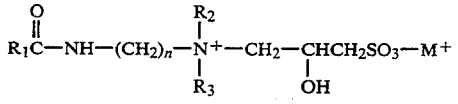

wherein $R_1$ is a saturated or unsaturated alkyl group having about 6 to about 24 carbon atoms, $R_2$ is a methyl or ethyl group, $R_3$ is a methyl or ethyl group, $M^+$ is about 1 to about 6, and $n^+$ is an alkali metal cation. The most preferred hydroxysultaine is a potassium salt of cocoamidopropyl hydroxysultaine.

The combination of the amine oxide and the sultaine functions to serve as a viscosity control agent while functioning as a means for the dispersion of lime soap.

The composition contains 0.05 to 3.0 wt %, more preferably 0.1 to 2.5 wt %, of an acidic gelling agent having the formula

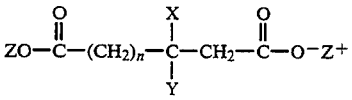

wherein n=0, 1 or 2, X is selected from the group consisting of hydrogen, an alkoxy group having 1 to 4 carbon atoms, and a hydroxy group, Z+ is selected from the group consisting of hydrogen and an alkali metal cation, and mixtures thereof, and Y is selected from the group consisting of hydrogen, $CO_2H$ and $CO_2-Z^+$.

The composition also preferably contains about 0.01 to about 1.5 wt % of a perfume, more preferably about 0.1 to about 1.0 wt %.

The balance of the composition is about 60 to about 90 wt % of water.

In the composition, it is believed that the triethanolamine salt of the refined tall oil (triethanolamine oleate) functions as a surfactant and emulsifier with respect to the dirt to be cleansed from the subject surface; the potassium salt of the refined tall oil functions not only as a surfactant and emulsifier with respect to the dirt to be cleansed from the subject surface, but also acts to prevent redeposition of the removed dirt, so as to prevent streaking and filming of the surface.

DETAILED DESCRIPTION OF THE PREFERRED EMBODIMENT

The following examples are only illustrative of the invention and are not meant to limit the scope of the claims of the inventions. The following compositions (in wt %) were prepared by first dissolving the tall oil fatty acid in the water and then neutralizing the tall oil fatty acid. The balance of the ingredients are added in the order listed with mixing to the aqueous solution of the metal neutralized tall oil fatty acid.

| | A | B | C |
|---|---|---|---|
| Deionized water | Balance | Balance | Balance |
| Tall oil fatty acid | 16.40 | 16.18 | 16.18 |
| KOH 45% | 6.90 | 6.90 | 6.90 |
| Cocoamidopropylamine oxide | 0.65 | 0.65 | 0.65 |
| Cocoamidopropylhydroxy sultaine | 0.53 | 0.53 | 0.53 |
| Triethanolamine | 0.33 | 0.33 | 0.33 |
| Ethyl alcohol | 0.16 | 0.16 | 0.16 |
| Perfume | 0.58 | 0.58 | 0.58 |
| Citric acid | | | 0.50 |
| Sodium gluconate | | 0.15 | |
| pH 10% solution | 10.90 | 11.80 | 10.70 |
| RVT Brookfield viscosity at RT | Liquid | Liquid | Pasty |
| #2 spindle | | | Liquid |
| RPM | 20 | 20 | 10 |
| CPs | 250 | 550 | 3,320 |

While particular embodiments of the invention and the best mode contemplated by the inventor for carrying out the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A cleaning composition which comprises approximately by weight:

a) 2 to 35% of at least one unsaturated fatty acid having about 8 to 24 carbon atoms;

b) 0.01 to 1.5% of an trialkanolamine;

c) 0.01 to 1.5% of an alkanol having about 1 to about 5 carbon atoms;

d) 1.0 to 5.0% of an alkali metal hydroxide;

e) 0.02 to 2.0% of an amine oxide;

f) 0.02 to 2.0% of a sultaine; and g) 0.05 to 3.0wt %, more preferably 0.1 to 2.5 wt %, of an acidic gelling agent having the formula:

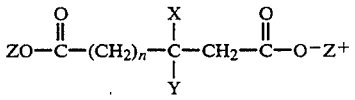

wherein n=0, 1 or 2, X is selected from the group consisting of hydrogen, an alkoxy group having 1 to 4 carbon atoms, and a hydroxy group, Z is selected from the group consisting of hydrogen and an alkali metal cation, and mixtures thereof, and Y is selected from the group consisting of hydrogen, $CO_2H$ and $CO_2^-Z^+$; and h) the balance being water, said composition having a Brookfield viscosity at room temperature, #2 spindle, 20 rpms greater than 2000 cps.

2. The cleaning composition according to claim 1, wherein said alkanol is ethanol, propanol or isopropanol.

3. The cleaning composition according to claim 2, wherein said trialkanolamine is triethanolamine.

4. The composition according to claim 3, wherein said metal hydroxide is potassium hydroxide.

5. The composition according to claim 1, wherein said amine oxide is characterized by the formula:

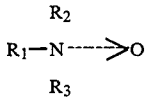

wherein $R_1$ is a $C_{12-16}$ alkyl and $R_2$ and $R_3$ are selected from the group consisting of methyl, ethyl, propyl, isopropyl, 2-hydroxethyl, 2-hydroxypropyl and 3-hydroxypropyl.

6. The composition according to claim 4, wherein said amine oxide is cocoamido-propylamine oxide.

7. The composition according to claim 1, wherein said sultaine is characterized by the formula:

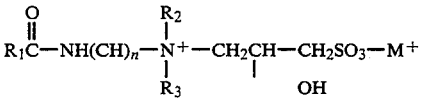

wherein n is about 1 to about 5, $M^+$ is an alkali metal cation, $R_2$ is a methyl or ethyl group, $R_3$ is a methyl or ethyl group, and $R_1$ is a saturated or unsaturated alkyl group having about 6 to about 24 carbon atoms.

8. The composition according to claim 6, wherein said sultaine is cocoamido-propylhydroxy sultaine.

9. The composition according to claim 1, wherein said unsaturated fatty acid is a tall oil fatty acid.

10. The composition according to claim 8, wherein said unsaturated fatty acid is a tall oil fatty acid.

11. The composition according to claim 9, further including about 0.01 to about 1.5 wt % of a perfume.

12. The composition according to claim 9, wherein the concentration of said tall oil fatty acid is about 4 to about 25 wt %.

13. A method of cleaning a surface, whereby a gloss or shine is imparted or restored to said surface if said surface initially presented a gloss or shine when clean, and cleaning of said surface is effected, comprising of the application of an effective amount to clean surface of a cleaning composition comprising:

a) 2 to 35% of at least one unsaturated fatty acid having about 8 to about 24 carbon atoms;

b) 0.01 to 1.5% of an trialkanolamine;

c) 0.01 to 1.5% of an alkanoi having about 1 to about 5 carbon atoms;

d) 1 to 5% of an alkali metal hydroxide;

e) 0.02 to 2.0% of an amine oxide;

f) 0.02 to 2.0% of a sultaine; and g) 0.05 to 3.0 wt %, more preferably 0.1 to 2.5 wt %, of an acidic gelling agent having the formula

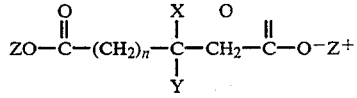

wherein n=0, 1 or 2, X is selected from the group consisting of hydrogen, an alkoxy group having 1 to 4 carbon atoms, and a hydroxy group, $Z^+$ is selected from the group consisting of hydrogen and an alkali metal cation, and mixtures thereof, and Y is selected from the group consisting of hydrogen, $CO_2H$ and $CO_2^-Z^+$; and h) the balance being water, said composition having a Brookfield viscosity at room temperature, #2 spindle, 20 rpms greater than 2000 cps.

14. The method according to claim 13, wherein said alkanol is, propanol or isopropanol.

15. The method according to claim 14, wherein said alkanol is triethanolamine.

16. The method according to claim 15, wherein said metal hydroxide is potassium hydroxide.

17. The method according to claim 13, wherein said amine oxide is characterized by the formula:

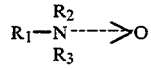

wherein $R_1$ is a $C_{12-16}$ alkyl and $R_2$ and $R_3$ are selected from the group consisting of methyl, ethyl, propyl, isopropyl, 2-hydroxyethyl, 2-hydroxypropyl, and 3-hydroxypropyl.

18. The method according to claim 16, wherein said amine oxide is cocoamido-propylamine oxide.

19. The method according to claim 13, wherein said sultaine is characterized by the formula:

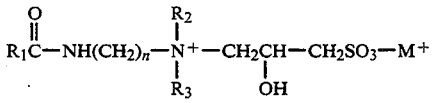

wherein n is about 1 to about 5, $M^+$ is an alkali metal cation, $R_2$ is a methyl or ethyl group, $R_3$ is a methyl or ethyl group, and $R_1$ is a saturated or unsaturated alkyl group having about 6 to about 24 carbon atoms.

20. The method according to claim 18, wherein said sultaine is cocoamidopropylhydroxy sultaine.

21. The method according to claim 20, wherein said unsaturated fatty acid is a tall oil fatty acid.

22. The method according to claim 20, wherein said unsaturated fatty acid is a tall oil fatty acid.

23. The method according to claim 21, further including about 0.01 to about 1.5 wt % of a perfume.

24. The method according to claim 21, wherein the concentration of said tall oil fatty acid is about 4 to about 25 wt %.

* * * * *